US008985970B2

(12) United States Patent
Spaggiari et al.

(10) Patent No.: US 8,985,970 B2
(45) Date of Patent: Mar. 24, 2015

(54) AXIAL VENTILATOR

(75) Inventors: Alessandro Spaggiari, Correggio (IT); Pietro De Filippis, Varazze (IT)

(73) Assignee: Spal Automotive S.r.l. (IT)

( * ) Notice: Subject to any disclaimer, the term of this patent is extended or adjusted under 35 U.S.C. 154(b) by 0 days.

(21) Appl. No.: 13/501,643

(22) PCT Filed: Oct. 26, 2010

(86) PCT No.: PCT/IB2010/054836

§ 371 (c)(1),
(2), (4) Date: Apr. 12, 2012

(87) PCT Pub. No.: WO2011/051880

PCT Pub. Date: May 5, 2011

(65) Prior Publication Data

US 2012/0201705 A1 Aug. 9, 2012

(30) Foreign Application Priority Data

Oct. 26, 2009 (IT) ..... BO2009A0694

(51) Int. Cl.
*F04D 29/34* (2006.01)
*F04D 29/26* (2006.01)
*F04D 29/32* (2006.01)

(52) U.S. Cl.
CPC ..... *F04D 29/263* (2013.01); *F04D 29/326* (2013.01); *F04D 29/329* (2013.01)
USPC ..... 417/423.1

(58) Field of Classification Search
CPC ..... F04D 29/34; F04D 29/281; F04D 29/282; F04D 29/322
USPC ..... 417/424.1, 423.1, 423.14; 416/204 R, 416/214 R, 244 R
See application file for complete search history.

(56) References Cited

U.S. PATENT DOCUMENTS 2,030,993 A * 2/1936 Langenkamp et al. .... 417/423.1
2,495,433 A 1/1950 Troller (Continued)

FOREIGN PATENT DOCUMENTS

DE 3941612 6/1991
EP 1205668 5/2002

(Continued)

OTHER PUBLICATIONS

International Search Report and Written Opinion dated Apr. 27, 2011 from related application.

(Continued)

*Primary Examiner* — Bryan Lettman
(74) *Attorney, Agent, or Firm* — Timothy J. Klima

(57) ABSTRACT

A ventilator (1) comprises an electric motor (2) comprising a casing (4), a rotor rotatable inside the casing (4) about an axis of rotation (R), a shaft (5) integral with the rotor and having at least one end portion (6) protruding from the casing (4); the ventilator (1) comprises a fan equipped with a plurality of blades (7), a hub (8) for mounting the blades (7) and comprising a bottom wall (9) for coupling to the shaft (5) and at least one perimeter portion (11) extending from the bottom wall (9) to define a base for connecting the blades (7); the hub (8) is defined by a rigid disc (8) and comprises a plurality of bases (11*a*) which extend from the bottom wall (9) at each of the blades (7) to define a connecting surface for joining each blade (7) to the bottom wall (9).

20 Claims, 8 Drawing Sheets

(56) References Cited

U.S. PATENT DOCUMENTS

| | | | | |
|---|---|---|---|---|
| 2,664,961 | A | 1/1954 | Goede | |
| 3,006,417 | A | 10/1961 | Busquet | |
| 3,231,022 | A | 1/1966 | Schroeter et al. | |
| 3,904,314 | A | 9/1975 | Pedersen | |
| 4,053,259 | A * | 10/1977 | Bianchi | 416/208 |
| 4,610,600 | A | 9/1986 | Bleier | |
| 5,224,347 | A | 7/1993 | Yakabe et al. | |
| 7,168,923 | B2 * | 1/2007 | Vasilescu et al. | 416/175 |
| 2003/0031561 | A1 | 2/2003 | Takeuchi et al. | |
| 2006/0140796 | A1 * | 6/2006 | Cheng | 417/423.5 |
| 2009/0196773 | A1 * | 8/2009 | Jiang et al. | 417/423.14 |

FOREIGN PATENT DOCUMENTS

| | | |
|---|---|---|
| EP | 1718872 | 12/2007 |
| GB | 630773 | 10/1949 |
| GB | 716389 | 10/1954 |
| GB | 1321261 | 6/1973 |
| JP | 48-109583 | 9/1973 |
| JP | H 10141281 | 5/1998 |
| JP | 2004-144033 | 5/2004 |

OTHER PUBLICATIONS

Chinese Office Action dated Mar. 26, 2014 from counterpart App No. 201080048264.4.

Chinese Office Action dated Jul. 29, 2014 from counterpart application No. 2012-534818.

Chinese Office Action dated Jan. 9, 2015 from counterpart app No. 201080048264.4.

* cited by examiner

AXIAL VENTILATOR

This application is the National Phase of International Application PCT/IB2010/054836 filed Oct. 26, 2010 which designated the U.S. and that International Application was published under PCT Article 21(2) in English.

This application claims priority to Italian Patent Application No. BO2009A000694 filed Oct. 26, 2009 and PCT Application No. PCT/IB2010/054836 filed Oct. 26, 2010, which applications are incorporated by reference herein.

TECHNICAL FIELD

This invention relates to an axial ventilator and, in particular, to an axial electric ventilator for automotive applications.

BACKGROUND ART

Prior art ventilators of reference in this specification, such as, for example, the one illustrated in FIG. 8 and labelled 100, comprise an axial fan 101 and an electric motor 102 for driving the fan.

The electric motor has a substantially cylindrical casing, a stator unit and a rotor unit, both housed in the casing, and a shaft protruding from the casing and rotationally driven by the rotor unit.

The fan has a connecting hub 103 coaxial with the shaft of the motor and a plurality of blades extending radially from the hub.

Usually, the fan hub is cup shaped, that is to say, it has a bottom wall 104 for connecting to the motor shaft and a substantially cylindrical lateral wall 105 from which the blades extend.

In order to limit the axial dimensions of the ventilator, the motor is at least partly housed inside the hub, surrounded by the lateral wall of the hub itself which extends from the bottom wall towards the motor.

A tubular gap 106 is defined between the motor casing and the fan hub, that is, between the casing and the lateral wall of the hub to allow the fan to rotate freely.

This type of ventilator has some disadvantages in heavy-duty applications such as agricultural machines or earthmoving machines.

In effect, in these applications, the performance of the ventilator may be seriously diminished by extraneous material such as straw, dust, soil, mud and so on, which finds its way into the gap 106 and prevents the fan from turning smoothly relative to the motor casing.

Under these circumstances, friction between the fan and the casing is increased, aeraulic performance is reduced and the motor may work with the rotor seized up and eventually break down.

To overcome these disadvantages, fans like the one described in patent EP1718872, to the same Applicant as this invention, have been developed. That patent relates to an axial fan where the bottom wall of the hub has openings in it from which the dirt that accumulates between the fan and the motor may be expelled during use.

In the event of prolonged use under heavy-duty conditions, however, the holes tend to become clogged, eventually bringing the fan to a stop.

In other prior art solutions, the fan hub is sealed and is defined by a box-shaped body.

Examples of hubs of this kind are described and illustrated in documents U.S. Pat. Nos. 2,664,961, 3,006,417, 3,904,314, 4,610,600, 3,231,022, 2,495,433, GB-A-630773 and GB-A-716389.

A detail of another prior art fan 101 is illustrated in FIG. 8*a*. In that fan, the hub 103 is defined by revolving a substantially T-shaped section 107.

In practice, the hub 103 is defined by a rigid disc 108 and an annular wall 109 connected at a middle portion of it to the disc 108.

The wall 109 forms a single part with the disc 108 and allows the blades 110 to be connected to the disc 108.

In this solution, too, however, as illustrated, gaps 111 are formed which are eventually filled by material such as mud, soil, sand and so on, leading to imbalance of the fan 101; the fan 101 illustrated in FIG. 8*a* also features reinforcement ribs 112.

DISCLOSURE OF THE INVENTION

In this context, the main technical purpose of this invention is to propose an axial ventilator which is free of the above mentioned disadvantages.

It is an aim of this invention to propose an axial ventilator which limits the risk of accumulated dirt bringing the fan to a stop.

Another aim of the invention is to propose an axial ventilator which limits the risk of accumulated dirt increasing friction and imbalance and leading to vibrations and/or noise.

A yet further aim of the invention is to propose an axial ventilator that can be used continuously for heavy-duty applications in the presence of mud, dust, soil and the like.

The stated technical purpose and aims of the invention are substantially achieved by a ventilator as described herein.

BRIEF DESCRIPTION OF THE DRAWINGS

Further features and advantages of the invention are more apparent in the detailed description below, with reference to a preferred, non-restricting, embodiment of a ventilator as illustrated in the accompanying drawings, in which.

DESCRIPTION OF THE PREFERRED EMBODIMENTS OF THE INVENTION

Figure 1:
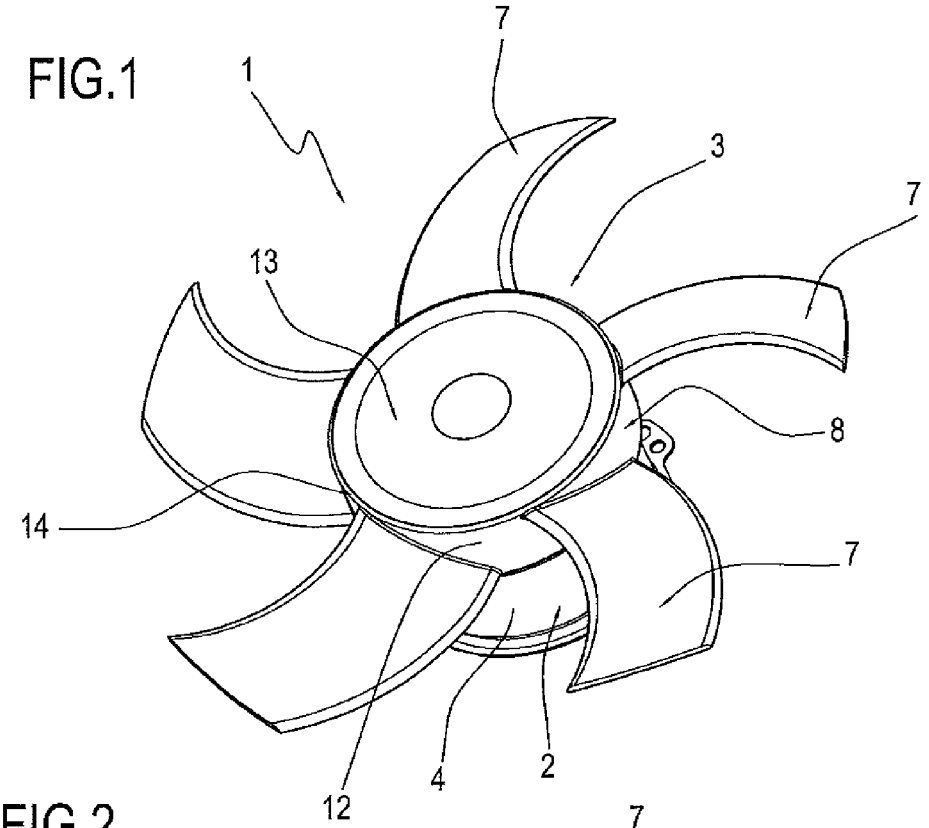
FIG. 1 is a schematic perspective view of a ventilator according to this invention.
Figure 2:
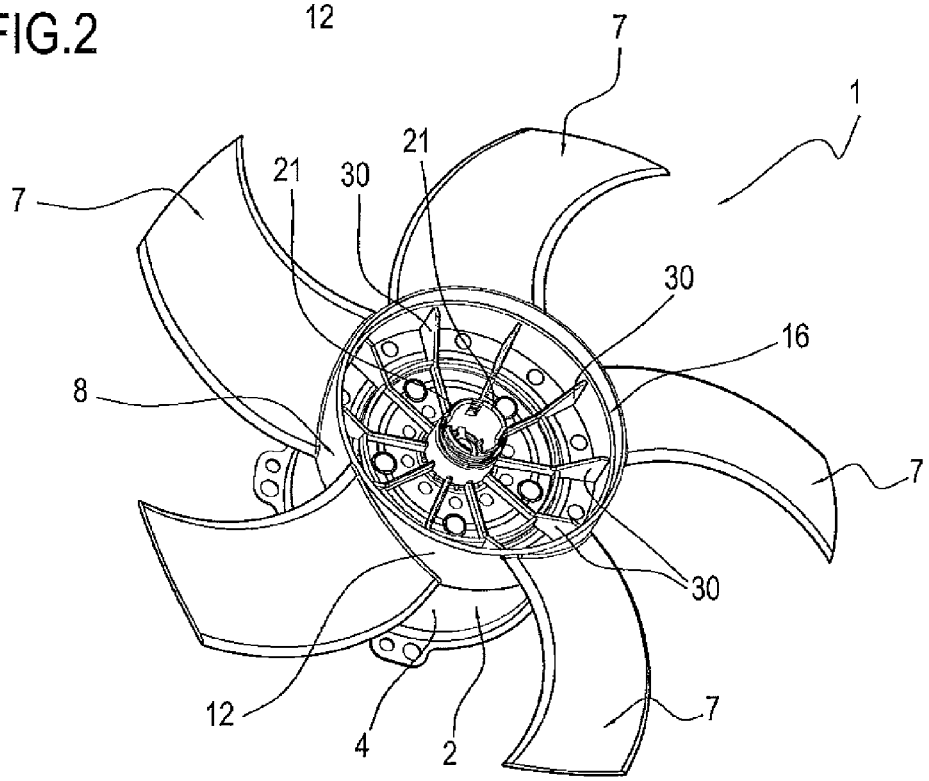
FIG. 2 is a different schematic perspective view, with some parts cut away in order to better illustrate others, of the ventilator of FIG. 1.

With reference to the accompanying drawings, the numeral 1 denotes a ventilator according to this invention.

Preferably, the ventilator 1 is of the heavy-duty type, that is to say, designed for use in conditions where straw, soil, mud, dust, water and other extraneous materials might prevent the ventilator 1 from functioning properly.

The ventilator 1 comprises an electric motor 2 and a fan 3, rotationally driven by the motor 2.

Schematically, the motor 2 comprises a casing 4, a stator, not illustrated, and a rotor, not illustrated, rotatable inside the casing 4 about an axis of rotation R.

The motor 2 is of a substantially known type and therefore described only insofar as necessary for understanding this invention.

The rotor of the motor 2 comprises a shaft 5 with an end portion 6 which protrudes from the casing 4 and to which the fan 3 is coupled.

The fan 3 comprises a plurality of blades 7 and a hub 8 for mounting the blades 7 and connecting the fan 3 to the shaft 5.

Figure 3:
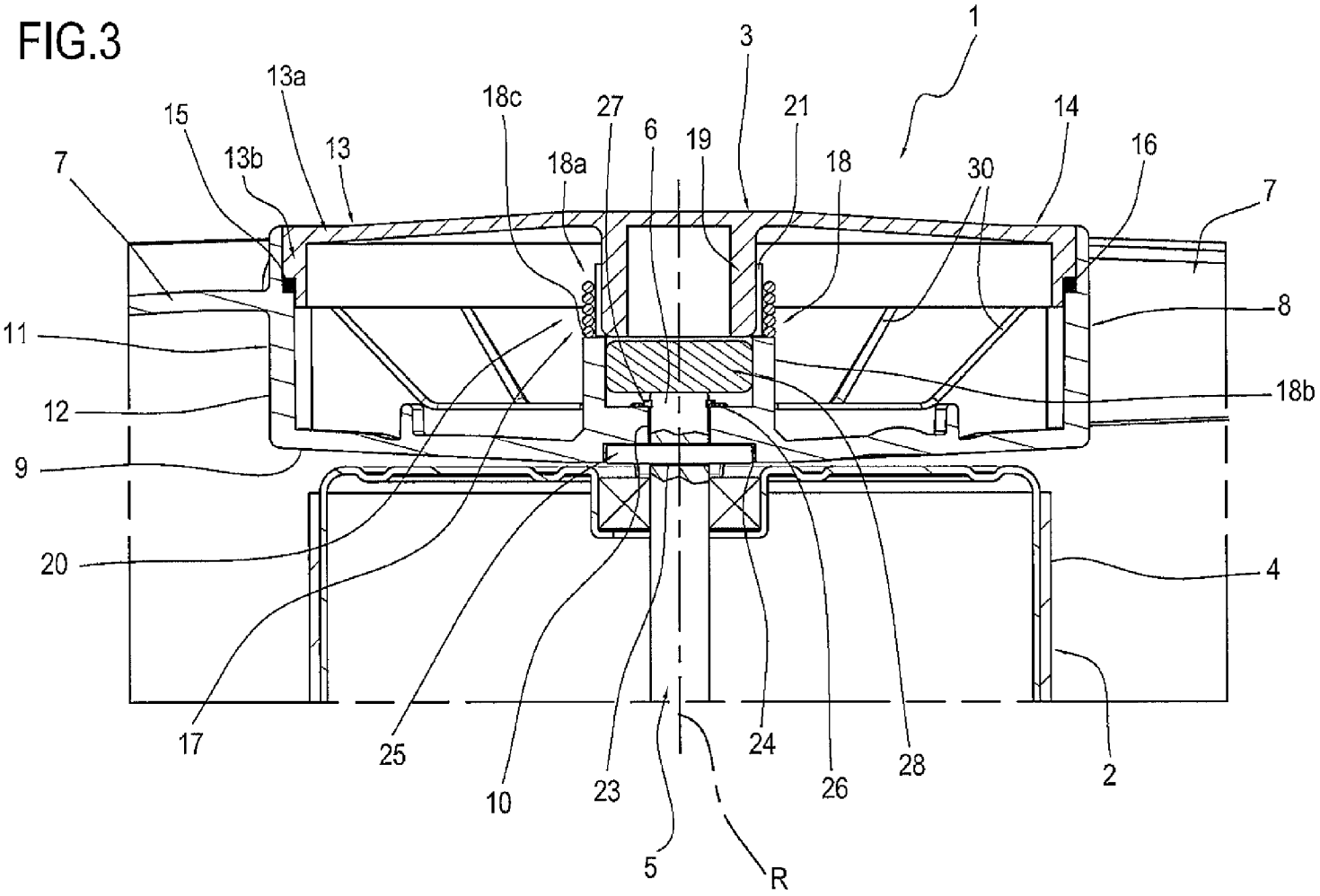
FIG. 3 is a suitably interrupted schematic cross section of the ventilator of the preceding figures.
Figure 4:
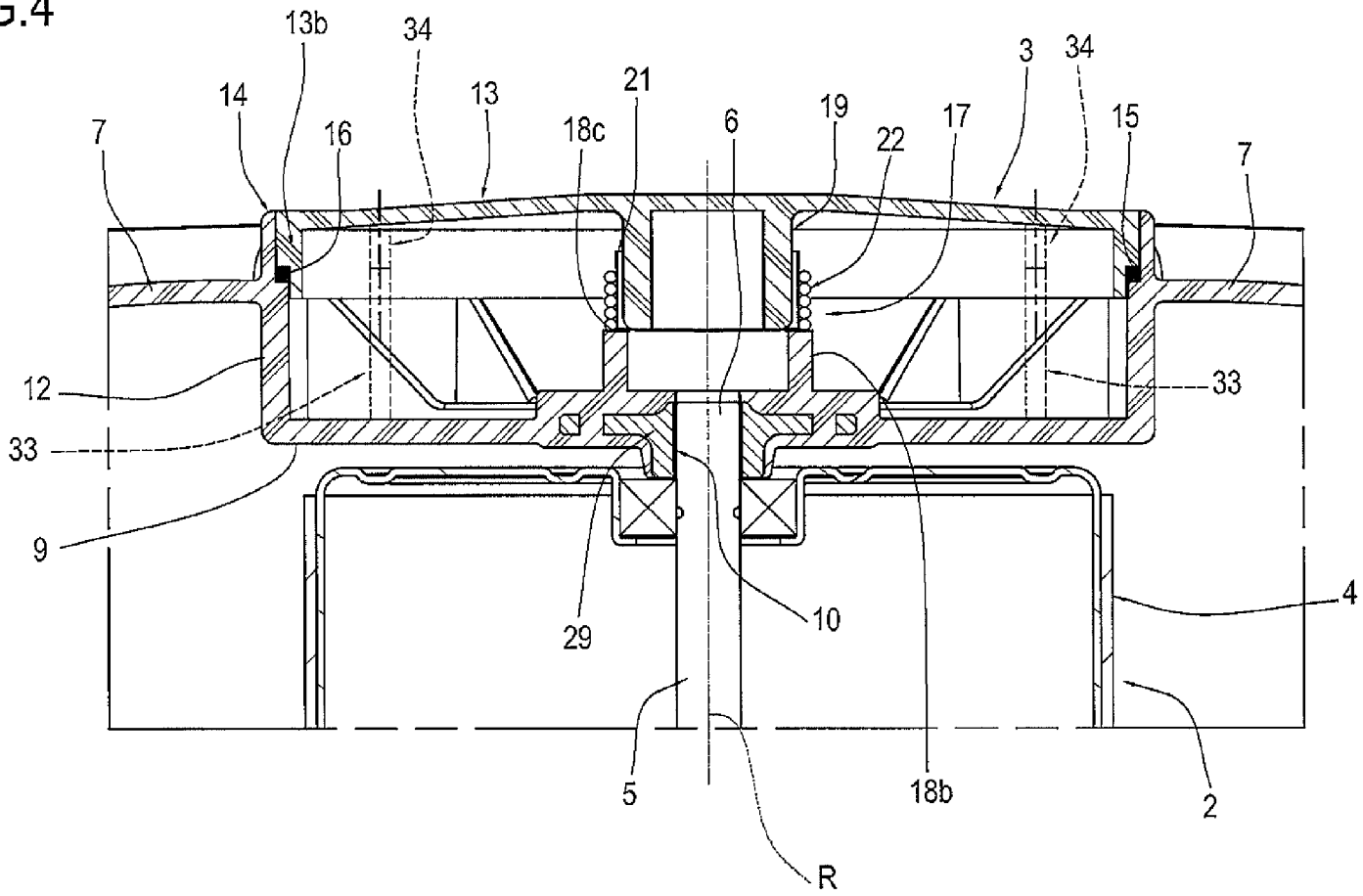
FIG. 4 illustrates a detail of a second embodiment of a ventilator according to the invention in a transversal cross section.

As illustrated in particular in FIGS. 3 and 4, the hub 8 has a bottom portion or wall 9 with a hole 10 made in it to allow it to be fitted to the shaft 5, and a perimeter portion or wall 11 which extends from the bottom portion 9.

The blades 7 are connected to the bottom portion 9 by the perimeter portion 11, which defines, in the hub 8, a connecting base for the blades 7.

As illustrated in FIG. 1 to 5, the perimeter portion 11 is substantially cylindrical and defines a cylindrical wall 12 for mounting the blades 7.

As clearly illustrated, the wall 12 extends from the bottom wall 9 on the side opposite the casing 4 with respect to the bottom wall 9 itself.

In other words, the bottom wall 9 and the cylindrical wall 12 give the hub 8 a cup shape extending on the side opposite the motor 2, which is not, therefore, housed inside the cup.

As illustrated, the bottom wall 9 has a smooth outside surface.

More precisely, the bottom wall 9 is smooth in the geometric sense, that is to say, it does not have protuberances, protrusions, recesses or the like.

In order to prevent extraneous materials from finding their way into the hub 8, the ventilator 1 comprises a cover 13, illustrated in FIGS. 1, 3, 4 and 5, for closing the cylindrical wall 12. Advantageously, as will become clearer as this description continues, the outside surface of the cover 13 is smooth.

In practice, the cover 13 closes the perimeter portion 11 on the side opposite the bottom wall 9.

The bottom wall 9, the perimeter portion 11, or more specifically, the cylindrical wall 12, and the cover 13, define a box-shaped body 14 that constitutes the hub 8 of the fan 3.

It should be observed that the outside surfaces of the body 14 are substantially smooth in order to facilitate the expulsion of mud, soil and the like thanks to the centrifugal force due to the rotation of the fan 3 during use.

More specifically, the outside surfaces of the bottom wall 9 and of the cover 13, that is to say, the outside surfaces of the walls of the body 14 transversal to the axis of rotation R are smooth in order to facilitate expulsion of dirt in a substantially radial direction by applying centrifugal force.

Figure 5:
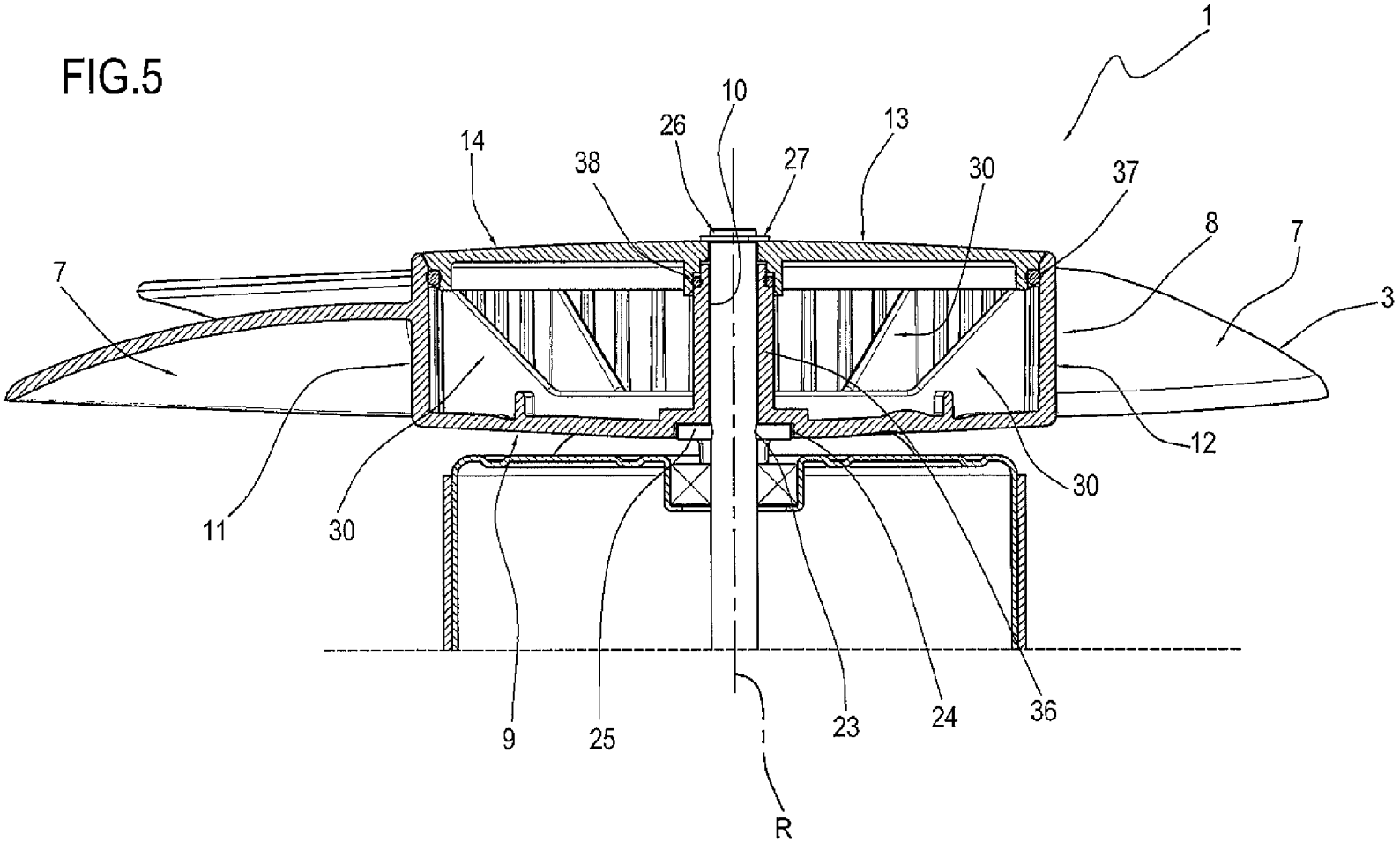
FIG. 5 illustrates a third embodiment of a ventilator according to the invention in a transversal cross section.

With reference to FIGS. 3 and 5, it should be noted that the bottom wall 9 is substantially frustoconical in shape, with vertex on the axis of rotation R and concavity facing the inside of the hub 8, in such a way as to assist in expelling the dirt from its outside surface.

The further the bottom wall 9 extends away from the axis of rotation R towards the periphery of the hub 8, the further it lies from the casing 4.

With reference to FIGS. 3 and 4 in particular, it should be noted that the ventilator 1 comprises an annular gasket 15 to better guarantee the seal between the cover 13 and the wall 12.

The cover 13 has a discoidal portion 13*a*, preferably suitable for insertion into the cylindrical perimeter portion 11, while the wall 12 has an abutment 16 against which the cover 13 stops.

The gasket 15 is preferably interposed between the cover 13 and the abutment 16.

Preferably, the cover 13 comprises a ring 13*b* which extends outwards from the discoidal portion 13*a* and is designed to be inserted into the wall 12.

Preferably, the discoidal portion 13*a* of the cover 13 is frustoconical in shape, with vertex on the axis of rotation R and concavity facing the inside of the hub 8 for expelling the dirt during use of the ventilator 1.

The ventilator 1 comprises a stop system 17 for keeping the cover 13 stably associated with rest of the hub 8.

More in detail, the system 17 operates between the bottom portion 9 and the cover 13.

The system 17 comprises a tube 18 coaxial with the bottom portion 9 and extending from the latter towards the cover 13.

The system 17 also comprises a pin 19 which extends centrally along the axis of rotation R and which is designed to be engaged in the tube 18.

In order to keep the pin 19 securely coupled within the tube 18, the ventilator 1 comprises locking means 20.

In the embodiment illustrated, the tube 18 has an end portion 18*a* close to the cover 13 and comprising flexible elements 21 that extend along the axis R.

The flexible elements 21 are movable between a close-up position, illustrated in FIGS. 3 and 4, and a spaced-apart position.

The movement between these two positions is permitted by the flexibility of the elements 21, which can therefore be tightened around the pin 19 in the close-up position.

The system 17 comprises a spring 22 fitted round the tube 18 in such a way as to impinge on the flexible elements 21.

The spring 22 forces the flexible elements 21 into the close-up position causing them to retain the pin 19.

Preferably, the tube 18 has a base portion 18*b* which extends from the cylindrical bottom wall 9. The flexible elements 21 extend from the base portion 18*b*.

Between the base portion 18*b* and the flexible elements 21, there is defined an annular abutment 18*c* against which the spring 22 stops.

In alternative embodiments not illustrated the cover 13 is fastened and sealed to the hub 8 by gluing the cover 13 to the hub 8.

Alternatively, the cover 13 might be welded, for example by laser or ultrasound welding, to the hub 8.

As illustrated in dashed line style in FIG. 4, the stop system 17 comprises pins 33, which extend from the bottom wall 9 towards the cover 13, and corresponding pins 34 which extend from the cover 13 towards the pins 33 and abut the latter end to end. The system 17 comprises screws, not illustrated, which engage in the pins 33 through the portion 13*a* of the cover 13 and the pins 34.

FIG. 5 shows another embodiment of a ventilator 1 according to the invention.

Inside it, the hub 8 of the fan 3 comprises an axial sleeve 36 inside which the shaft 5 passes and which extends for the full axial dimension of the hub 8 itself.

In practice, the sleeve 36 defines the hole 10 through which the shaft 5 passes.

In the preferred embodiment illustrated, the sleeve 36 extends substantially for the full height of the hub 8, that is, approximately the same height as the perimeter portion 11.

A first annular gasket 37 is interposed between the perimeter portion 11 and the cover 13.

A second annular gasket 38 is interposed between the cover 13 and the sleeve 36 and the fastening of the cover 13 to the hub 8 is described in more detail below.

FIGS. 3 and 5 illustrate a first system of coupling the fan 3 to the shaft 5.

The shaft 5 has a hole 23 passing through it transversally of the axis of rotation R and accommodating a peg 25 whose ends protrude from the shaft 5 itself.

The bottom wall 9 of the hub 8 has a radial slot 24 passing through the axis R and designed to receive the peg 25 and, more specifically, the ends of the latter.

The slot 24 is formed on an outside face of the bottom wall 9, that is to say, on the side of the latter opposite the cylindrical perimeter wall 11.

In the embodiment of FIG. 3, the portion of the shaft 5 that is inside the box-shaped body has an annular groove 26 made in it for receiving a snap ring 27.

In other words, the annular groove 26 is formed in the end portion 6 of the shaft 5 on the side opposite the slot 24, or the through hole 23, with respect to the bottom wall 9.

Advantageously, the distance between the hole 23 and the annular groove 26 substantially corresponds to the thickness of the bottom wall 9.

To prevent impurities and dirt from getting into the box-shaped body 14 through the hole 23 for the passage of the shaft 5, the fan 2 comprises a sealing element 28 located between the bottom wall 9 and the shaft 5.

More specifically, the sealing element 28 is forced into the tube 18, inside the box-shaped body 14, in coaxial manner creating a tight seal against the wall of the tube 18 itself.

In practice, once the fan 3 has been coupled to the shaft 5 using the peg 25 and the fan 3 has been locked to the shaft using the snap ring 26, the seal is enhanced by inserting the element 28 into the tube 18.

The lower portion 18*b* of the tube 18 thus defines a housing for the sealing element 28.

In the embodiment of FIG. 5, the annular groove 26 is formed on the end of the shaft 5 which, in this embodiment, extends beyond the cover 13.

In other words, the shaft passes right through the box-shaped body 14 and the hub 8 is locked by the snap ring 27 and held to the shaft 5 by the peg 25 which rotationally drives the fan 3.

In this case, the sealing action of the seal inside the hub 8 is guaranteed by the gaskets 37, 38 for closing the cover 13.

It should be noted that preferably it is the snap ring 27 that keeps the cover 13 locked to the hub 8 since the shaft 5 passes right through the box-shaped body 14.

In practice, in this embodiment, the ring 27 locks both the hub 8 and the cover 13 to the shaft 5, holding them together in a closed configuration.

As illustrated in FIG. 4, the fan 3 comprises a bushing 29 coaxial with the hub 8 and co-moulded in the latter's bottom wall 9.

In this case, the fan 3 is coupled to the shaft 5 by an interference fit and the seal that keeps extraneous material out of the box-shaped body 14 is guaranteed by the bushing 29.

More specifically, the seal is guaranteed by the tight coupling between the shaft and the bushing 29.

Preferably, in both of the embodiments, as illustrated in FIGS. 3, 4 and 5, the structure of the hub 8 is stiffened by ribs 30 formed on the inside of the box-shaped body 14.

As illustrated, the ribs 30 are arranged radially and their profile increases from the centre to the periphery of the hub 8 in such a way as to make the hub strong enough to support the added weight of dirt that might settle on the blades 7.

When assembling the ventilator 1, particularly the embodiments of it illustrated in FIGS. 3 and 4, the fan 3, that is, the bottom wall 9 combined with the wall 11 of the hub 8, are coupled to the shaft 5 in the above mentioned ways.

The spring 22 is fitted round the tube 18 in such a way as to bend the flexible elements 21 towards the axis of rotation R.

Next, after fitting the gasket 15, the cover is coupled to the box-shaped body 14, positioning it so it is coaxial with the latter and inserting the pin 19 between the flexible elements 21 which hold it in position.

The hub 8 made in the above manner, whether with or without the reinforcement ribs 30, is sufficiently stiff to guarantee the correct operation of the ventilator 1.

Placing the motor entirely on the outside of the fan also makes the ventilator particularly efficient for heavy-duty applications because there are no interstices where dirt can accumulate.

Alternatively, in the embodiment of FIG. 5, the hub 8 is locked to the shaft 5 by the peg 25, and the cover 13 is also placed on the shaft 5 after interposing the gaskets 37 and 38, and pressed against the hub 8.

The box-shaped body 14 is then securely locked axially by the snap ring 27.

Figure 6:
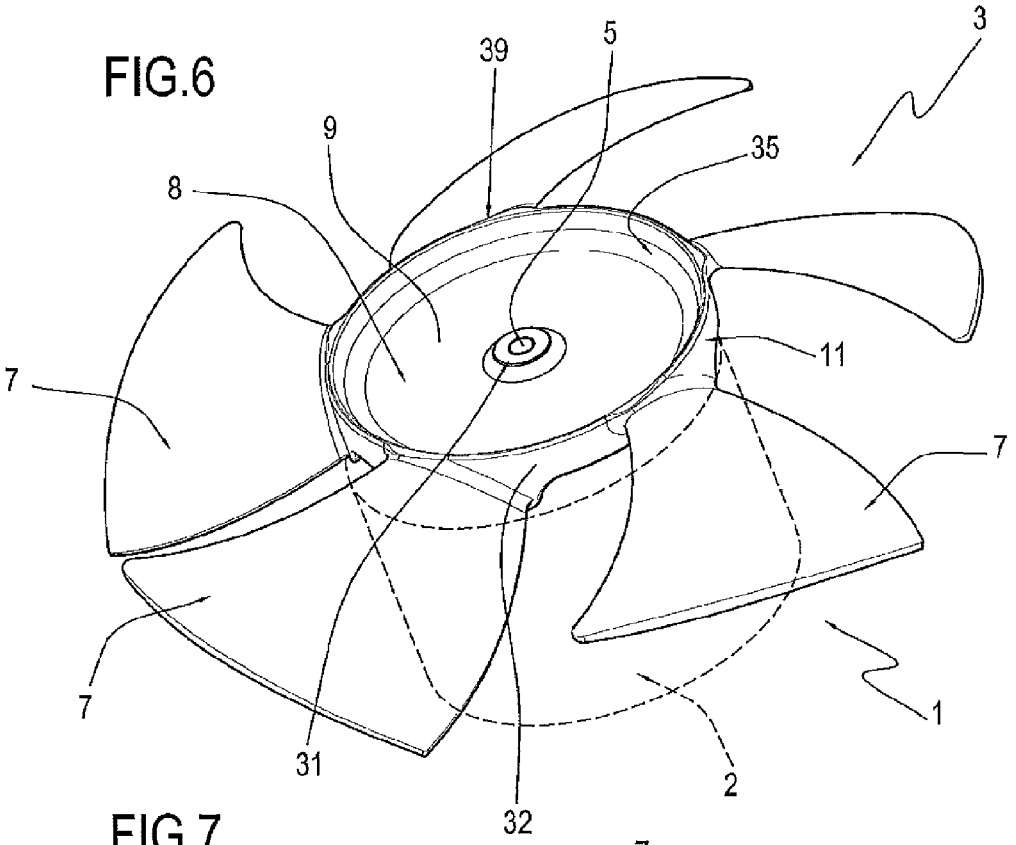
FIG. 6 illustrates a fourth embodiment of a ventilator according to the invention in a perspective view from above.
Figure 7:
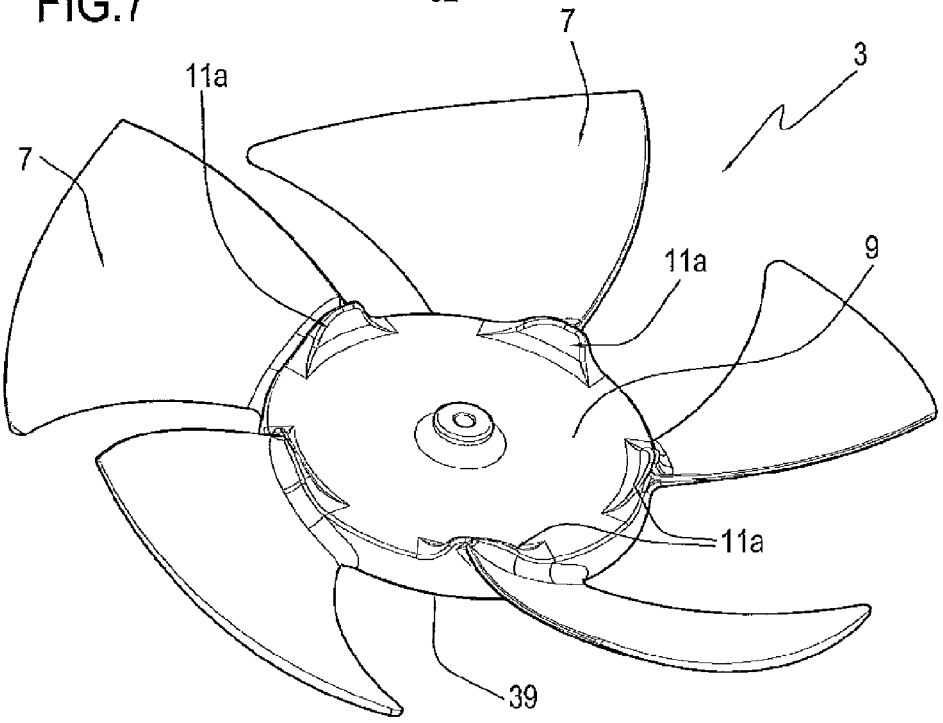
FIG. 7 is a perspective view from below of the fan of the ventilator of FIG. 6.

FIGS. 6 and 7 show a third embodiment of a fan according to this invention.

In the case of low-power ventilators, for example, less than 100 watts, the fan 3 comprises the hub 8, whose bottom wall 9 allows the fan 3 to be coupled to the shaft 5, and the perimeter portion 11 for mounting the blades 7.

In practice, in the case of low-power units, the box-shaped hub 8 of the embodiments described above, is merely a rigid disc.

In this embodiment, too, the hub 8 does not surround the motor but, to limit axial dimensions and optimize mouldability in connection with the reduced dimensions and power, is in the form of a disc.

Preferably co-moulded in the bottom wall 9, there is a bushing 31 which guarantees the coupling of the fan 3 to the shaft 5 by an interference fit.

Alternatively, in another embodiment that is not illustrated, the hub 8 is made entirely of a plastic material and the end portion 6 of the shaft 5 is machined in such a way as to present longitudinal protrusions.

By way of an example, these protrusions are obtained by "pinching" the cylindrical outside surface of the shaft.

The term "pinching" is used to mean squeezing the cylindrical surface of the shaft according to a direction transversal, in particular perpendicular, to the directrices of the surface itself.

In the hub 8 of FIGS. 6 and 7 the perimeter portion or wall 11 extends from the bottom portion 9 on the side opposite the motor 2.

The wall 11 has a substantially cylindrical outside face 32 and an inside face 35 facing the axis of rotation R and connected to the bottom wall 9.

In this embodiment, the hub 8 is defined by a rigid disc 39 comprising the portion 9 and the portion 11 which the blades 7 are associated with.

The wall 11 forms a sort of circular crown 11 which extends on the periphery of the wall 9.

Advantageously, at least the inside face 35 diverges from the bottom wall 9 outwards and away from the axis of rotation R.

That way, any dirt that settles on the hub 8, in particular on the bottom wall 9 may be expelled by centrifugal force without encountering obstacles.

The crown 11 contributes to conferring on the fan 3 the rigidity necessary for its correct operation.

As illustrated in particular in FIG. 7, on the side opposite the crown 11 there extend from the bottom wall 9 a plurality of bases 11*a* substantially at each blade 7.

The surface connecting each blade 7 to the base wall 9 is therefore defined by a portion of the perimeter wall 11 and by the corresponding base 11*a*.

This configuration, too, is particularly suitable for heavy-duty applications because it does not have interstices where extraneous material can accumulate.

More specifically, none of the surfaces of the bases 11*a* extends in a direction at right angles to the centrifugal (radial) direction.

FIGS. 9 to 11*a* show a yet further preferred embodiment of the ventilator according to the invention.

As illustrated, the hub 8 is defined by the rigid disc 39 comprising the bottom wall 9 which allows the fan 3 to be coupled to the shaft 5.

Preferably, the hub 8 has walls which are smooth in the geometrical sense and still more preferably, it is made by revolving a substantially triangular section to form a frustoconical body which confers strength and rigidity on the hub 8 itself.

Figure 11:
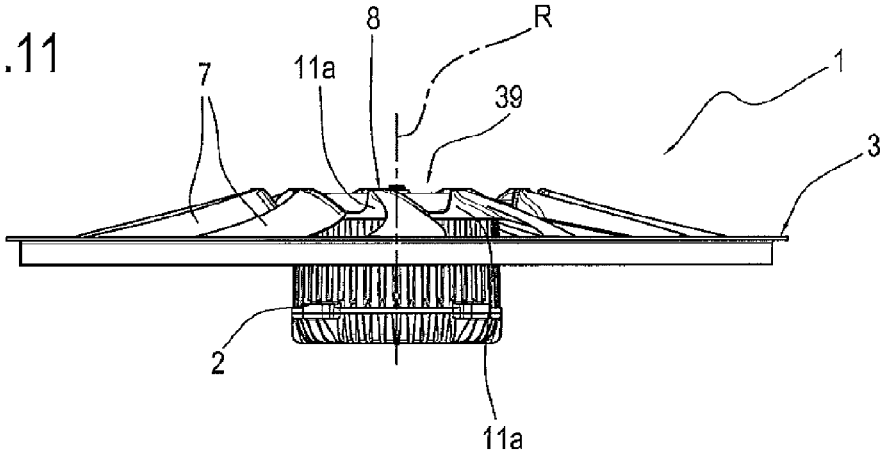
FIG. 11 is a schematic side view of the ventilator of FIGS. 9 and 10.
Figure 11A:
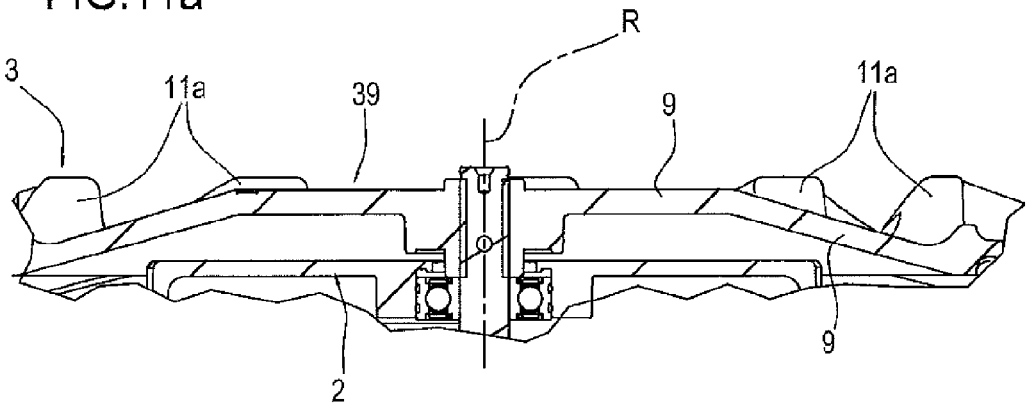
FIG. 11*a* is a suitably interrupted schematic cross section of the ventilator of FIG. 11.

More in detail, as illustrated in FIG. 11*a*, the bottom wall 9 has the form of a frustoconical surface.

Advantageously, the concavity of the bottom wall 9 faces the motor 2.

In other words, the frustoconical hub 8 formed substantially by the bottom wall 9, is defined as a portion of a conical surface whose vertex is on the axis of rotation R and whose concavity faces the motor 2.

Preferably, the conicity is such as to guarantee that dirt of any kind and nature can be expelled by the centrifugal force generated during rotation of the fan 3.

More in detail, in the solution illustrated, the motor 2 has facing it the inside surface of the hub 2 which is substantially conical and which facilitates the expulsion of dirt.

It should be noted that, as already mentioned, dirt may give rise to static and/or dynamic imbalance which may lead to vibrations and noise and reduce the working life of the ventilator itself.

This shape is optimal also for moulding the fan.

Figure 8:
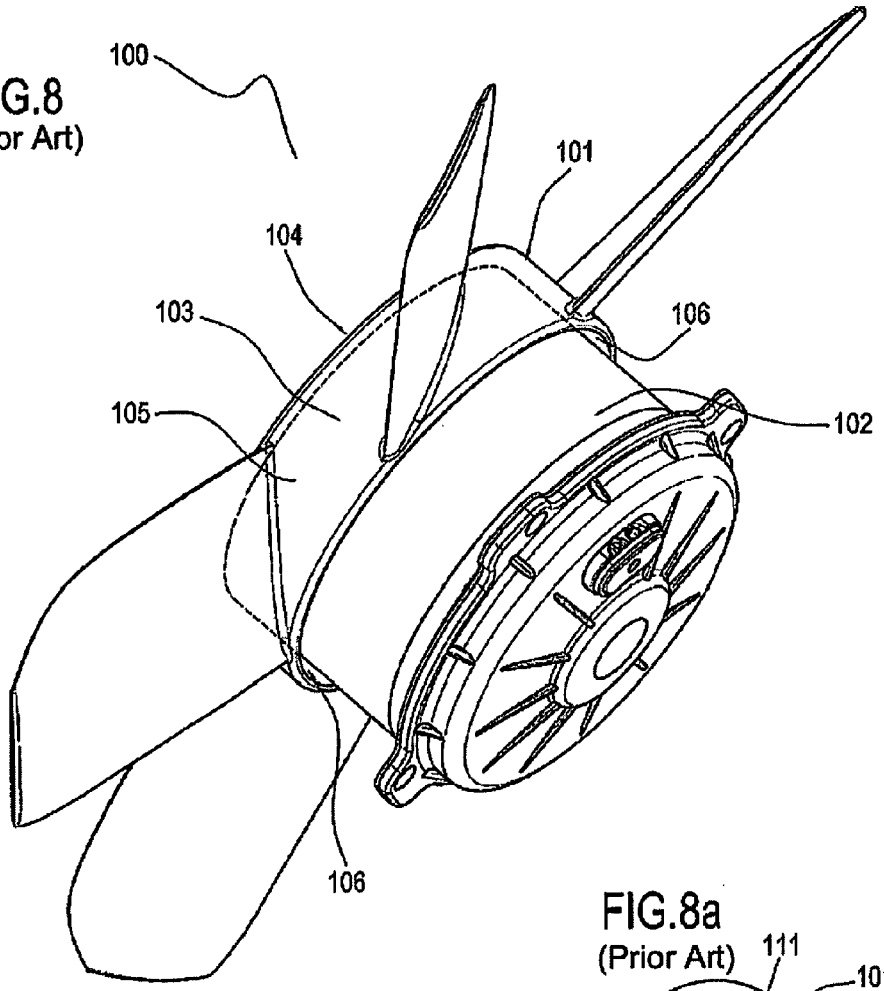
FIG.8 (Prior Art)
FIG. 8 is a schematic perspective view of a prior art ventilator.
Figure 8A:
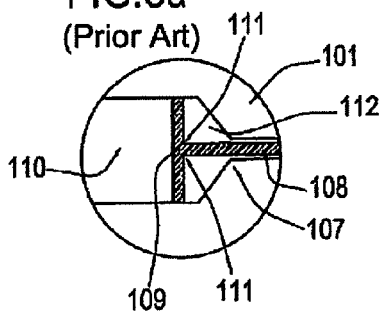
FIG.8a (Prior Art)
FIG. 8*a* is a schematic cross section of a detail of a prior art fan.

Preferably, as illustrated, and unlike the prior art solution shown in FIGS. 8 and 8*a*, the section of revolution of the hub 8 has no surfaces extending at right angles to the direction of the centrifugal force (the radial direction) since such surfaces would acts as traps for the dirt.

The absence of such surfaces guarantee that not only dirt but any kind of material, whether solid, such as dust, sand, fine particles of straw or hay, or liquid, mainly rainwater or condensate, may be trapped inside the hub, whatever the assembly position.

The solution described is particularly advantageous for use in roof-mounted applications such as in buses and vans, since any condensate and rainwater that may collect can be immediately expelled by centrifugal force as soon as the ventilator is switched on, thus preventing noise, imbalances and oxidization and/or corrosion of metallic parts, if any.

In order to allow the blades 7 to be connected to the hub 8, a plurality of bases 11*a* extend from the bottom wall 9 on the opposite side with respect to the motor 2 substantially at each blade 7.

The surface connecting each blade 7 to the base wall 9 is therefore defined by the corresponding base 11*a*.

In other words, the hub 8 is provided with a plurality of undercuts 40, between each blade 7 and the blade 7 adjacent to it.

The undercuts 40 are defined between adjacent bases 11*a*.

This configuration is particularly suitable for heavy-duty applications because it does not have interstices where extraneous material can accumulate. Any extraneous material can be expelled through the undercuts 40 as soon as the fan 3 starts turning.

Advantageously, also, as mentioned above, the face of the hub 8 facing the motor 2 is completely smooth and defined by the base wall 9 so as to facilitate expulsion of any dirt that may have accumulated between the fan and the motor.

With reference in particular to FIG. 11, it may be observed that, preferably, in order to confer suitable stiffness on the fan 3, the blades 7 extend from the hub 8 towards the motor 2 to form a substantially frustoconical surface.

The axial dimensions of the ventilator are thus reduced.

Preferably, each undercut 40 is located at the trailing edge of the respective blade 7.

Preferably, in order to make the air moved by the fan 3 strike the motor 2 directly to guarantee cooling, the diameter of the rigid disc 39 is approximately equal to the outside diameter of the motor 2.

In other words, the hub 8 is substantially equal in diameter to the motor 2.

Preferably, the largest diameter of the bottom wall 9 in the frustoconical configuration is substantially equal to the diameter of the motor 2.

Figure 9:
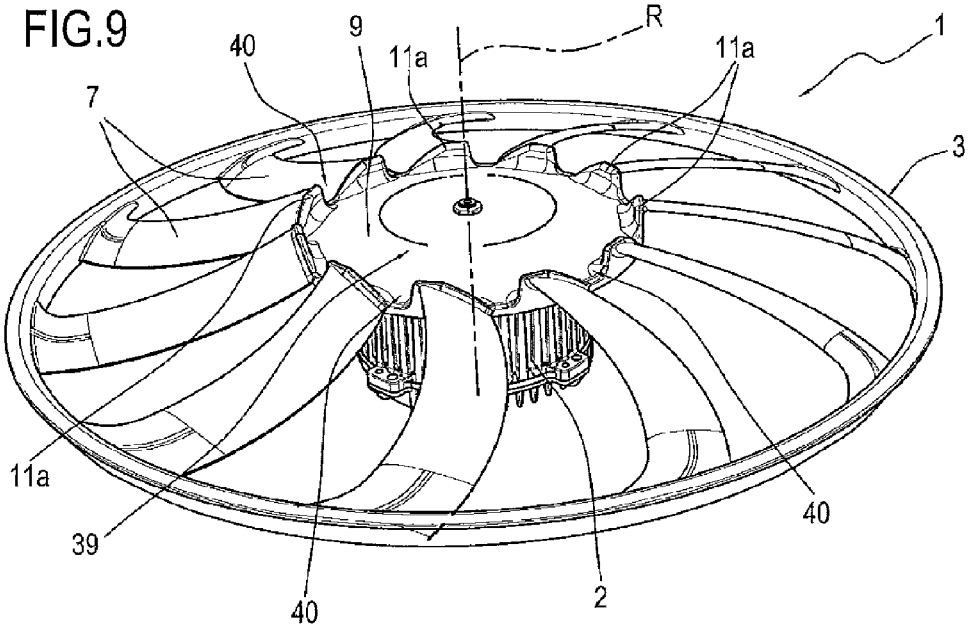
FIG. 9 illustrates a fifth embodiment of a ventilator according to the invention in a perspective view from above.
Figure 10:
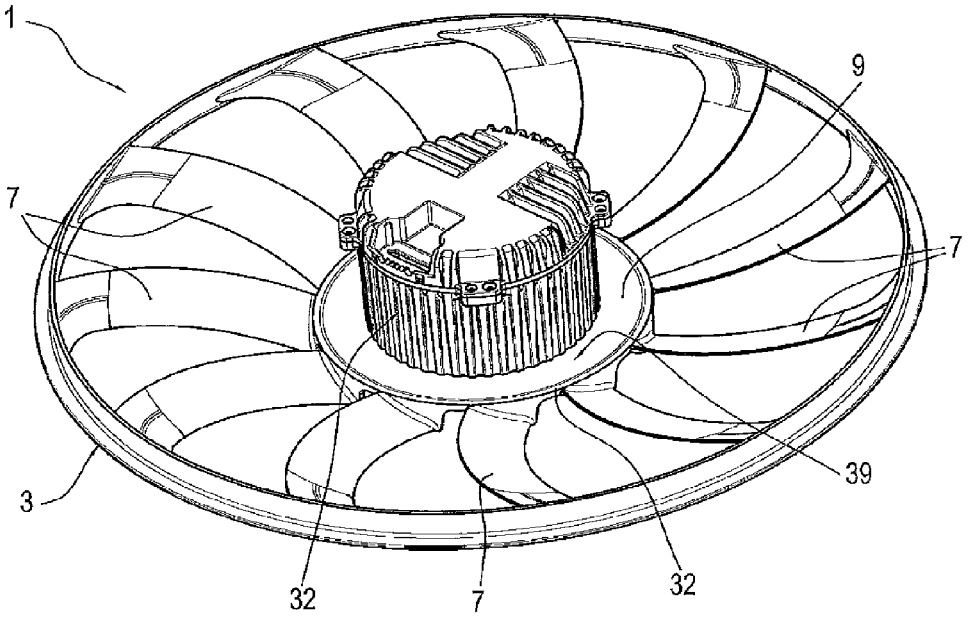
FIG. 10 is a perspective view from below of the ventilator of FIG. 9.

In the embodiments illustrated in FIGS. 9 to 11, the bases 11*a* themselves define the perimeter portion 11 for connection to the blades 7.

It should be observed that the embodiment illustrated in FIGS. 6 and 7 is preferably used when the available axial dimensions are not large enough to fit a frustoconical hub 8. In this case, therefore, the bases 11*a* protrude at least partly towards the motor 2.

This is the case mainly when the diameter of the hub 8 is almost equal to the diameter of the motor 2.

Generally speaking, the frustoconical shape of the hub is created preferably when the disc 39 is larger enough in diameter than the motor 2 and, still more preferably, when the bases 11*a* protrude from the wall 9 on the side opposite the motor.

In other words, the frustoconical shape of the bottom wall 9 is preferable when the axial dimensions of the bases 11*a*, extending on the side opposite the motor 2 are smaller than the axial dimensions of the wall 9 itself.

The invention brings important advantages. The hubs described have smooth surfaces which facilitate expulsion of dirt by centrifugal force in such a way as to protect the fan for example from imbalances.

The hub is well clear of the motor, with enough space between them to avoid creating gaps and interstices where dirt can accumulate and lead to ventilator malfunctioning.

The invention claimed is:

1. A ventilator comprising an electric motor comprising a casing, a rotor rotatable inside the casing about an axis of rotation, a shaft integral with the rotor and having at least one end portion protruding from the casing, and a single piece integrally molded plastic molded fan associated with the end portion, the fan comprising:

a plurality of blades, and a hub for mounting the blades, the hub comprising a bottom wall for coupling to the shaft and a perimeter portion extending from the bottom wall for connecting the blades, the perimeter portion comprising a plurality of bases extending from the bottom wall, one base at each of the blades to define a connecting surface for integrally joining each blade to the bottom wall, the perimeter portion being open between the plurality of bases, the bottom wall being a single disc having an axially inner side facing the motor and an exposed axially outer side facing away from the motor, the single disc being a sole connection between the perimeter portion and the coupling with the shaft;

any structure on the axially inner side of the single disc extending in a direction toward the motor shaped to be at least one chosen from facing radially outwardly and inclined radially outwardly to assist in expulsion of material from between the single disc and motor by centrifugal force.

2. The ventilator according to claim 1, wherein the bases extend from the bottom wall on a side opposite the motor.

3. The ventilator according to claim 2, wherein the perimeter portion consists of the plurality of bases.

4. The ventilator according to claim 1, wherein the bottom wall is defined by a frustoconical surface having a concavity facing the motor.

5. The ventilator according to claim 4, wherein a largest diameter of the bottom wall is equal to a diameter of the motor.

6. The ventilator according to claim 1, wherein the hub has a geometrically smooth face facing the motor.

7. The ventilator according to claim 1, wherein the blades extend from the hub towards the motor to form a frustoconical surface.

8. The ventilator according to claim 1, wherein the perimeter portion extends from the bottom wall at least partly on a side opposite the casing with respect to the bottom wall to define a circular crown.

9. The ventilator according to claim 8, wherein the perimeter portion has a cylindrical outside surface and an inside surface facing the axis of rotation and joined to the bottom wall.

10. The ventilator according to claim 9, wherein at least the inside surface diverges from the bottom wall away from the axis of rotation.

11. The ventilator according to claim 8, wherein the bases extend at least partially from the bottom wall on a side opposite the circular crown at each of the blades.

12. The ventilator according to claim 1, wherein the bases delimit a plurality of undercuts between each blade and the blade adjacent to it, each of the plurality of undercuts being defined by an adjacent pair of the bases.

13. The ventilator according to claim 12, wherein each of the plurality of undercuts is located at a trailing edge of the respective blade.

14. A ventilator comprising:

an electric motor comprising a casing, a rotor rotatable inside the casing about an axis of rotation, a shaft integral with the rotor and having at least one end portion protruding from the casing, a fan associated with the end portion, the fan comprising a plurality of blades, a hub for mounting the blades, the hub comprising a bottom wall for coupling to the shaft and at least one perimeter portion extending from the bottom wall to define a base for connecting the blades, a closing device for closing the hub to form a box-shaped body, the closing device comprising a cover for closing the perimeter portion on an opposite side with respect to the bottom wall to form the box-shaped body, a stop device operating on the cover to keep the cover stably associated with the hub, the stop device comprising a first engagement mechanism extending from the bottom wall towards the cover and a second engagement mechanism extending from the cover to securely clasp the first engagement mechanism, and a locking device for fastening the first engagement mechanism to the second engagement mechanism;

wherein the first engagement mechanism comprises at least a first and a second flexible element movable between a close-up position and a spaced-apart position, the second engagement mechanism comprising at least one pin positionable between the first and second flexible elements, the pin being retained by the first flexible element and by the second flexible element in the close-up position, the locking device comprising an elastic element operating on the first and second flexible elements to keep them in the close-up position.

15. The ventilator according to claim 14, wherein the first and second engagement mechanisms extend along the axis of rotation.

16. The ventilator according to claim 14, wherein the perimeter portion extends from the bottom wall at least partly on the side opposite the casing with respect to the bottom wall.

17. The ventilator according to claim 16, wherein the bottom wall has a seat coaxial with the shaft, the ventilator comprising a second seal having a gasket insertable in the seat.

18. The ventilator according to claim 14, wherein the bottom wall is frustoconical in shape with a vertex on the axis of rotation and concavity facing the inside of the hub.

19. The ventilator according to claim 14, wherein the cover comprises a discoidal portion for closing the hub and being frustoconical in shape with a vertex on the axis of rotation and concavity facing the inside of the hub.

20. A ventilator comprising an electric motor comprising a casing, a rotor rotatable inside the casing about an axis of rotation, a shaft integral with the rotor and having at least one end portion protruding from the casing, a fan associated with the end portion, the fan comprising:

a plurality of blades, and a hub for mounting the blades, the hub comprising a bottom wall for coupling to the shaft and a perimeter portion extending from the bottom wall for connecting the blades, the perimeter portion comprising a plurality of bases extending from the bottom wall at each of the blades to define a connecting surface for integrally joining each blade to the bottom wall, the bottom wall being a single disc having an axially inner side facing the motor and an exposed axially outer side facing away from the motor, the single disc being a sole connection between the perimeter portion and the coupling with the shaft;

any structure on the axially inner side of the single disc extending in a direction toward the motor shaped to be at least one chosen from facing radially outwardly and inclined radially outwardly to assist in expulsion of material from between the single disc and motor by centrifugal force, and wherein the bottom wall is defined by a frustoconical surface having a concavity facing the motor.

* * * * *